US005540007A

United States Patent [19]

Kulp et al.

[11] Patent Number: 5,540,007

[45] Date of Patent: Jul. 30, 1996

[54] HIGHWAY SIGNS CAPABLE OF BEING ROLLED UP

[75] Inventors: Jack H. Kulp, San Juan Capistrano, Calif.; John D. McKenney, Arroyo Seco, N.M.

[73] Assignee: Traffix Devices, Inc., San Clemente, Calif.

[21] Appl. No.: 144,880

[22] Filed: Oct. 27, 1993

[51] Int. Cl.[6] ..... G09F 15/00

[52] U.S. Cl. ..... 40/610; 40/612; 248/165; 248/434; 403/102

[58] Field of Search ..... 40/606, 610, 612, 40/607, 603, 604; 248/159, 165, 176, 434, 435; 403/101, 102, 103

[56] References Cited

U.S. PATENT DOCUMENTS

| | | | |
|---|---|---|---|
| 1,588,575 | 6/1926 | Grunwald | 248/435 X |
| 1,846,988 | 2/1932 | Buck | 40/603 |
| 2,517,433 | 8/1950 | Hoven et al. | 40/320 X |
| 2,902,239 | 9/1959 | Janecke, Jr. | 248/165 X |
| 3,563,592 | 2/1971 | Preston | 403/102 X |
| 3,899,843 | 8/1975 | Doyle et al. | 40/612 X |
| 4,980,984 | 1/1991 | Kulp et al. | 40/610 |

*Primary Examiner*—Brian K. Green
*Attorney, Agent, or Firm*—Edward J. DaRin

[57] ABSTRACT

A regulatory flexible highway sign of rectangular configuration that may be rolled up for transport and for storage is disclosed. The rolled up "sign" package and a foldable sign stand for securing the sign in a message display position are disclosed. When the flexible highway sign is arranged in a display position, it is vertically supported by means of a pair of angularly oriented, long flexible members by a holding assembly constructed and designed to permit pivotal movement of the two flexible members between an angularly oriented sign displaying position and a side by side disassembled position whereby the pivot for the flexible members does not bear a load. The sign per se is maintained in a display position by frame members secured thereto including a pair of longitudinal members pivotably secured to the sign so that when longitudinally aligned secure the flexible sign in a display position. This is achieved by means of a sliding C-clamp member.

15 Claims, 5 Drawing Sheets

FIG. 1.
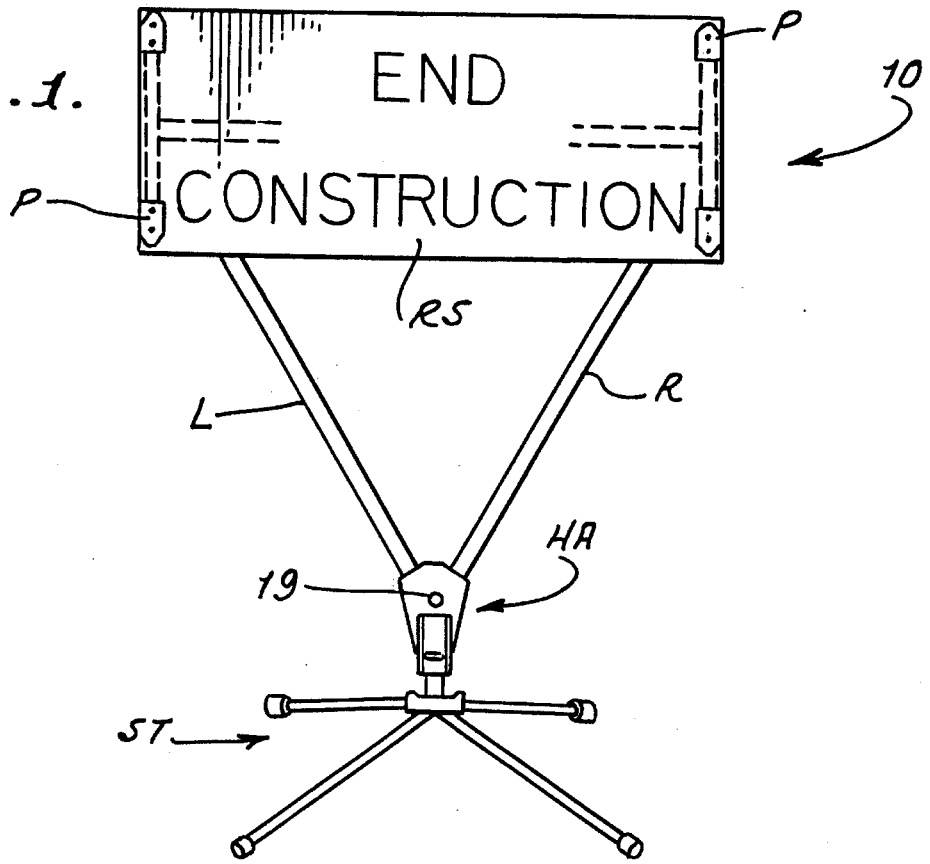
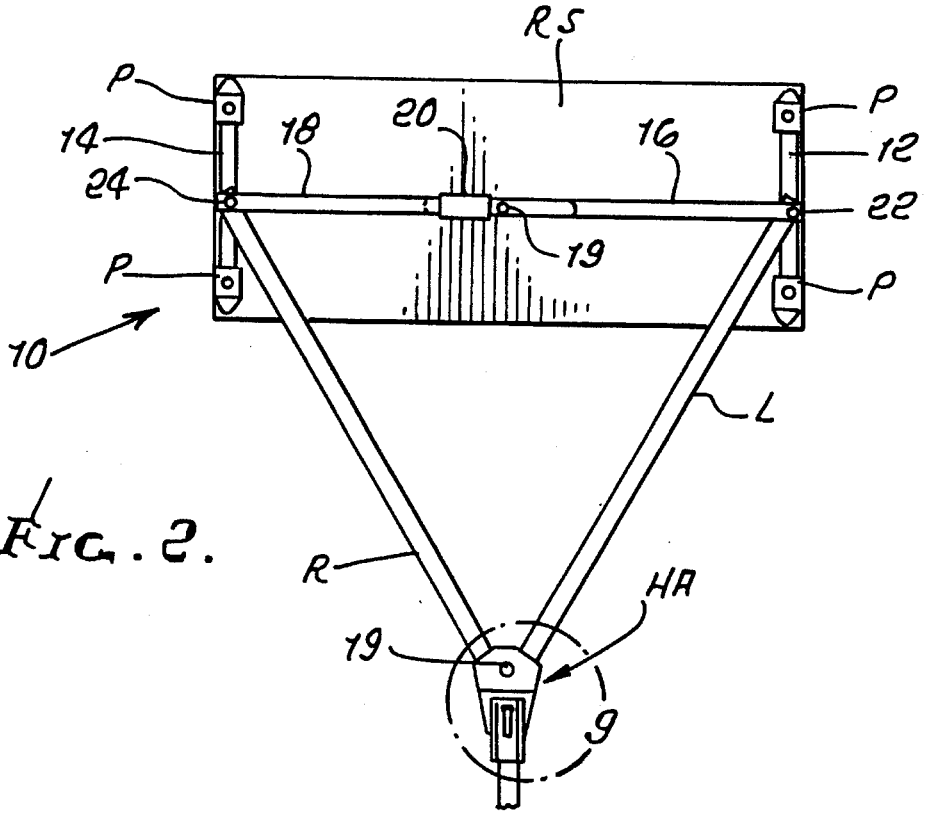
FIG. 2.

HIGHWAY SIGNS CAPABLE OF BEING ROLLED UP

FIELD OF THE INVENTION

This invention relates to temporary highway signs and more particularly to flexible, regulatory highway signs capable of being disassembled and rolled up for convenience of storage and for transport.

BACKGROUND OF THE INVENTION

Flexible, temporary highway signs for advance warning to a motorist of an approaching unsafe driving area or construction site are well known in the art. A flexible highway sign capable of being disassembled and rolled up for convenience for storage and portability is exemplified by the teachings in U.S. Pat. No. 4,980,984, assigned to the same assignee as the present invention. The disclosed, patented, highway sign utilizes a lightweight, flexible material such as a reflective vinyl plastic and a fluorescent mesh that allows the sign to be readily rolled up and unrolled with the flexible frame members. These advance warning signs are arranged to be displayed in a diamond configuration; i.e. a square mounted on one end. The flexible signs are maintained in a display configuration by the utilization of reinforcing or frame members on the non-message side of the sign. The reinforcing frame members are preferably constructed of a flexible material such as a glass reinforced polyester, plastic pulltrusions of commercial availability. The plastic pulltrusions permit the sign to respond to winds or wind gusts impinging thereon by bending, without breaking or tipping over and returning to its original position without taking a set. In contrast therewith a regulatory sign is generally of a rectangular shape and carry a regulatory message to be viewed by motorists, such as "END CONSTRUCTION". Present day, known regulatory signs are of a rectangular configuration and are permanently secured in position to a surface. Accordingly, there is a present need for an improved, regulatory highway sign capable of being quickly, temporarily erected on a surface and capable of being disassembled, rolled up for storage and portability so as to be used at different locations.

SUMMARY OF THE INVENTION

The present invention provides an improved, temporary regulatory highway sign of a rectangular configuration that can be quickly assembled together and disassembled without the use of fasteners, tools or special skills. A regulatory sign is generally of a rectangular configuration and may have a length many times greater than its width. The sign per se may be constructed of a lightweight plastic reflective material mounting flexible frame members including a pair of longitudinally extending members that can be pivoted between an open position and an overlapping, extended position to permit the sign to be rolled up or placed in a message displaying position. The sign is held in a vertical display position by a pair of long, flexible members having a preselected length for mounting the sign at a desired distance above the supporting surface. For this purpose, the pair of flexible members are pivotably secured to the sign at opposite sides therewith in common with the sign frame members to allow the flexible members to extend, angularly, downwardly from the regulatory sign. An improved, unique, holding assembly is provided for holding the free ends of the long flexible members in the desired angular relationship and secured thereto and yet movable within the holding assembly without damage to the flexible members with use. The holding assembly is adapted to be readily slipped into a portable sign stand for mounting the sign in a display position.

From a broad structural standpoint, the present invention comprehends a flexible message panel having a preselected quadrilateral configuration and capable of being rolled up for storage and transportation and opened up to assume a substantially flat message displaying position. For display purposes,a pair of pulltruded, glass reinforced plastic frame members are removably secured along opposed individual edges of the message panel. The control of the extended, display position is provided by a further pair of plastic frame members pivotally secured at one end to an individual one of the first edge mounted frame members on the sign with the opposite ends free. An improved C-shaped clamp is slidably mounted on one of the pair of plastic frame members so that when the free ends of the frame member are pivoted to be in longitudinal alignment they may be secured together by moving the C-shaped clamp over the side by side free ends of the frame members thereby securing the sign in a display position. The C-shaped clamp has a preselected length and is tapered from one end to the other for slidably receiving the free ends of the frame members at one end of the clamp and to snugly secure the ends together adjacent the pivot point therefor when fully mounted to the frame members.

When the regulatory sign is vertically extended by the provision of a pair of long flexible members pivoted to the sign and extending angularly downwardly, a unique holding assembly is provided for holding the flexible members in the desired angular relationship and adapted to be mounted to a portable sign stand. The holding assembly comprises a plurality of plates for defining individual channels for each of the ends of flexible members in their display, angular relationship and to be pivotably secured to the holding assembly to allow the flexible members to sway with the winds and yet not loading the pivot pin so as to prevent the splitting of the flexible members. The holding assembly has one end adapted to allow it to be readily mounted to a portable, foldable sign stand.

BRIEF DESCRIPTION OF THE DRAWINGS

These and other features of the present invention may be more fully appreciated when considered in the light of the following specification and drawings, in which:

FIG. 1 is a front elevational view of the highway regulatory sign arranged in a display position and mounted on a sign stand by means of a holding assembly and embodying the present invention;

FIG. 2 is a partial, rear elevational view of the highway sign of FIG. 1;

DETAILED DESCRIPTION OF THE PREFERRED EMBODIMENT OF THE INVENTION

Figure 3:
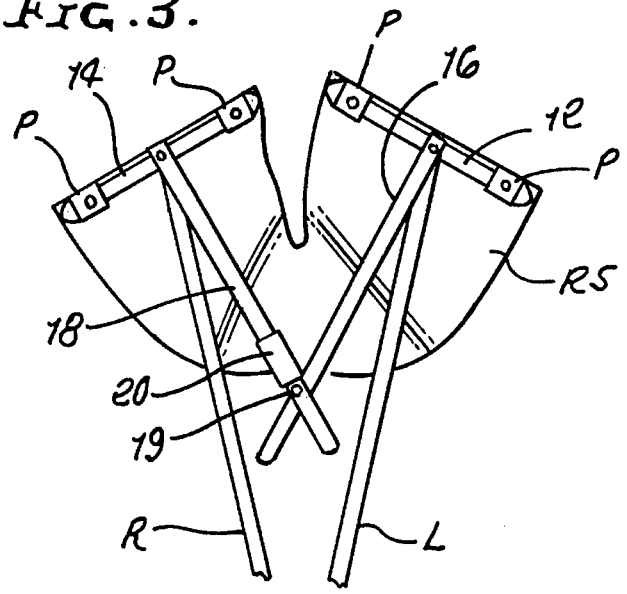
FIG. 3 is a partial, rear elevational view of the sign of FIG. 2 with the sign illustrated in a partially collapsed position.

Now referring to the drawings, the presently preferred embodiment of the regulatory highway sign assembly 10 will be described in detail. The regulatory sign RS is illustrated in FIG. 1 in its display position with the illustrated, exemplary regulatory legend thereon to be viewed by the oncoming motorists. The highway sign RS is provided with reinforcing members arranged on the non-display side of the sign, as best illustrated in FIG. 2. A pair of reinforcing frame members 12 & 14 are removably mounted to the opposite edges of the signs. A pair of the ends of frame members 16 & 18 are pivotably secured to the frame members 12 & 14 respectively intermediate the ends of members 12 & 14. The remaining ends of the members 16 & 18 are pivotably secured at a preselected point spaced from their ends by a pivot fastener 19 and further provided with a C-shaped sliding clamp 20 for receiving and securing the members in longitudinal alignment and secured together for maintaining the sign RS in a display position. The sign includes a pair of long, flexible members R and L pivotably mounted in a holding assembly HA which in turn is secured to the traffic stand ST. The traffic stand ST is of a known commercial construction that may be readily folded for transport and unfolded to set up the sign RS in a display position.

The sign RS when rolled up for transport is rolled up around the frame members 12, 14 16 and 18 and the long members R and L while being secured in the holding assembly but with the members R and L pivoted to a side by side relationship. This sign "package" and the sign stand ST are the only parts that have to be assembled together to erect the sign RS in a display position. Once the sign stand ST is unfolded and set up as in FIG. 1, then only the holding assembly HA needs to be mounted on the stand and the sign RS opened up and secured in the display position illustrated in FIG. 1. as will be described more fully hereinafter.

Figure 4:
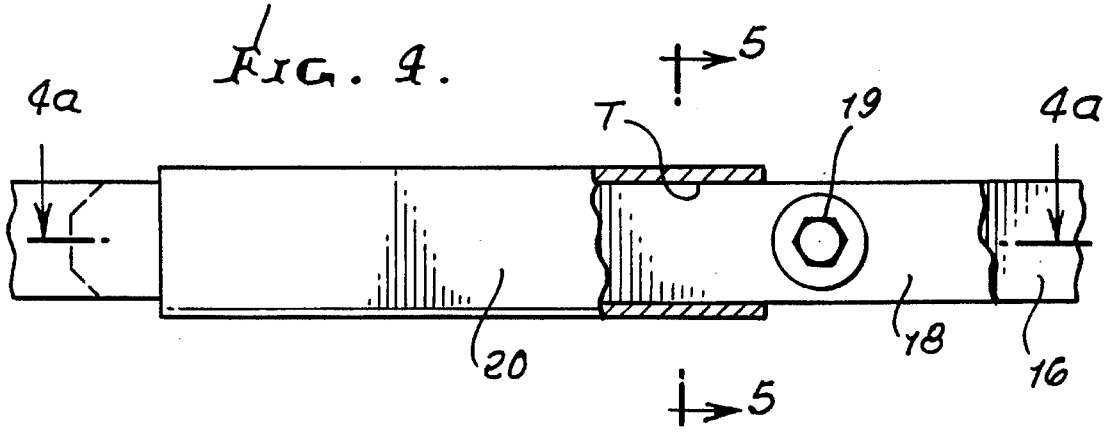
FIG. 4 is an enlarged view, with portions broken away, of the C-shaped clamp securing the frame members in a longitudinal aligned position as illustrated in FIGS. 1 & 2.

With this general understanding in mind, the details of the construction of the sign RS will be first described. The sign RS is constructed of commercially available construction and preferrably utilizes a lightweight, flexible material, such as a reflective vinyl plastic or a fluorescent mesh that allows the sign to be readily rolled up so as to keep the sign faces and regulatory message in good condition for re-use. The rectangular sign RS illustrated has a length many times its width but may be of any desired quadrilateral configuration consistent with regulatory sign requirements. To maintain the sign RS in a display configuration, reinforcing members are provided along the edges of the sign width, namely the flexible members 12 & 14 mounted on the backside of the sign, see FIG. 2. All of the reinforcing members for the sign are preferably constructed of a flexible material that will permit the sign RS to movably respond to wind and wind gusts impinging thereon. The reinforcing members are preferably constructed of a glass reinforced polyester, plastic pulltrusions that are of a commercially available construction. The frame members 12 & 14 are removably mounted to a pair of corner pockets of any known construction such as the corner pockets available from the Reflexite Corporation at 315 South Street, New Britain, Conn. 06050 or the improved corner pockets constructed of a softer, flexible material of the polyurethane type disclosed in the copending application bearing Ser. No.08/115908 and assigned to the same assignee as the present invention. The corner pockets P are arranged at each of the four corners of the sign RS and arranged along the width edges with the socket openings for the pockets P facing each other to mount the reinforced members 12 & 14 as seen best in FIG. 2. As is well known, the pockets P are secured to the sign RS with a reinforcing plate arranged on the message side of the sign. The remaining, flexible frame members 16 & 18 each have an end pivotably secured to the edge mounted reinforcing members 12 and 14, by pivot fasteners 22 and 24 mounted with the members 12 and 14 respectively. The pivot fastener 19 pivotably secures the members 16 and 18 longitudinally extending between the frame members 12 and 14 at a preselected point adjacent the ends of the frame members 16 and 18 as seen in FIGS. 2 and 3. In accordance with the present invention, the frame members 16 and 18 are releasably maintained in longitudinal alignment by means of a sliding C-shaped clamp 20 slidably mounted to one of the frame members 16 and 18, the member 18 as illustrated in FIGS. 2,3 and 4 so as to move from a locking position as illustrated in FIGS. 2 and 4 to an unlocked position as best seen in FIG. 3.

To better appreciate the simplicity of the C-shaped clamp 20 the detailed construction thereof will be examined. The clamp 20 has a preselected length many times greater than its width, which in turn is dimensioned relative to the width of the frame members 16 and 18, namely to receive the frame members in the "C" opening. This rectangular tubular C-shaped configuration is tapered from end to end with the opening T for the clamp 20 being the largest in width and is tapered in decreasing size from end to end. When mounted on the frame member 18, the large opening T, or the mouth of the clamp is arranged adjacent the fastener 19 and the smaller opening is at the opposite end.

Figure 5:
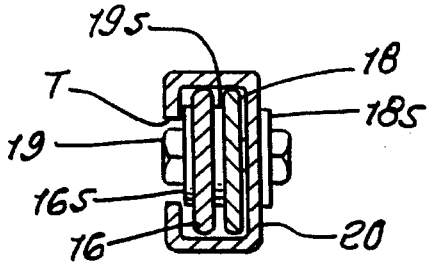
FIG. 5 is a cross-sectional view taken along the line 5—5 of FIG. 4.
Figure 4A:
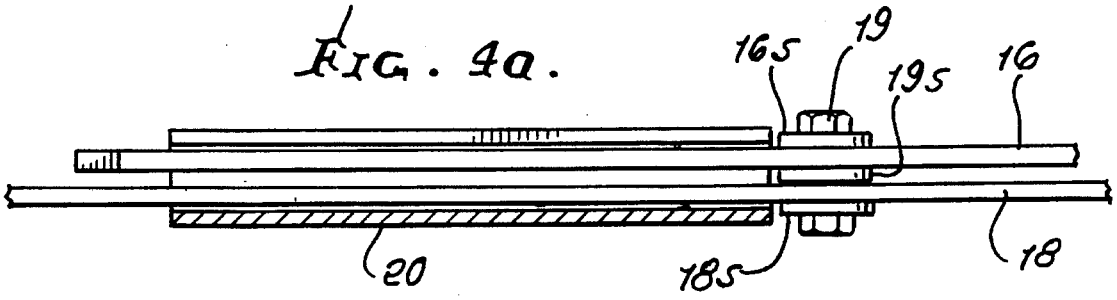
FIG. 4*a* is a top view, taken along the line 4*a*—4*a* of FIG. 4.

The clamp 20 is constructed and defined with a preselected width for receiving the longitudinally aligned frame members 16 and 18 when the clamp is moved thereover. The opposite end T of the clamp 20 has a slightly larger opening than its opposite end to accommodate the aligned portions of the frame members 16 and 18 immediately adjacent the pivot fastener 19, as viewed in FIGS. 4 and **4*a*, for example. The pivot fastener 19 is secured to the members 16 and 18 by spacer means and including the central spacer 19S and spacers 16S and 18S mounted on the opposite sides of the members 16 and 18; see FIGS. 4*a* and 5. The latter spacers or washers 16S and 18S are of conventional construction. The central spacer 19S, however, is provided in accordance with the present invention with a preselected, thin, thickness to maintain the portions of the members 16 and 18 to the outside of the fastener 19, or the right hand side as illustrated in FIGS. 4 and 4*a*, in a preselected spaced relationship. The thickness of spacer 19S controls the pressure exerted between the members 16 and 18 at the clamp 20. This in concert with the differences in the end widths of the opening of the clamp 20 causes the locking action on the members 16 and 18 as the clamp is moved to the right, as illustrated in FIGS. 4 and 4***a*, toward the pivot fastener 19. The selection of the thickness of the spacer 19S governs the width of the clamp 20 for receiving the members 16 and 18, so that their flexibility causes them to move inwardly, slightly within the clamp 20 adjacent the end T to produce the locking action between the C-shaped clamp 20 at the end T and the members 16 and 18 when in the locked position illustrated in FIGS. 4 and 4*a*. For this purpose, the width T is made only slightly larger than the thickness of the members 16 & 18 and the spacer 19S. The use of the glass reinforced polyester, plastic pulltrusions lend themselves admirably to this locking action due to their flexibility. With this arrangement, the clamp 20 will not back away from its locked position in the use of the sign RS to cause the sign to collapse from the desired display position but can be readily moved away from the locked position by the sign user.

The clamp 20, then, is freely slidable on the member 18 along the length of member 18 from the fastener 19 back. When the free ends of the frame members 16 and 18 are arranged in a longitudinal, side by side alignment for erecting the sign RS, the large open end T will receive the aligned, free ends of the member 16 at the large opening T and as the clamp 20 is moved towards the pivot fastener 19 will cause the ends of the members 16 and 18 to be releasably locked to one another due to the decreasing size of the opening of the clamp to thereby hold the sign RS in a flat, display position. Likewise, to release the clamp 20 from its locked position as illustrated in FIG. 4, the clamp 20 needs only to be moved away from the fastener 19, or to the left as illustrated in FIG. 4. This will cause the free ends of the members 16 and 18 to become disengaged from the clamp 20 so they will pivot towards one another in the manner illustrated in FIG. 3 to permit the sign RS to be rolled up. This simple means of releasably locking the frame members 16 and 18 by means of the clamp 20 renders the set up of the sign 10 simple and easy.

The sign RS may be temporarily tied to the secured frame members 16 and 18 by means of a strap secured to the back side of the sign RS (not shown). A velcro strap is presently preferred and can be used to secure the rolled up configuration of the sign.

A pair of long frame members R and L are provided to permit the sign RS to be erected a preselected distance above ground level. The members R and L are flexible and preferably constructed of a glass reinforced polyester, plastic pulltrusions as the frame members are for the sign RS. One end of each member R and L is individually pivoted to the edge frame members 12 and 14. As illustrated, the member L is pivoted to the frame member 12 in common with the frame member 16 at the pivot fastener 22. On the opposite side of the sign RS, the member R is coupled in common with the frame member 18 at the pivot fastener 24; see FIG. 2. In this fashion, the members R and L will extend downwardly from the pivot members 22 and 24 so as to be held in a preselected configuration for mounting to the sign stand ST. According to the present invention, it is desired that the free ends of the members R and L be pivoted together and extend upwardly to the pivot members 22 and 24 in a V configuration as illustrated in FIGS. 1 and 2.

Figure 6:
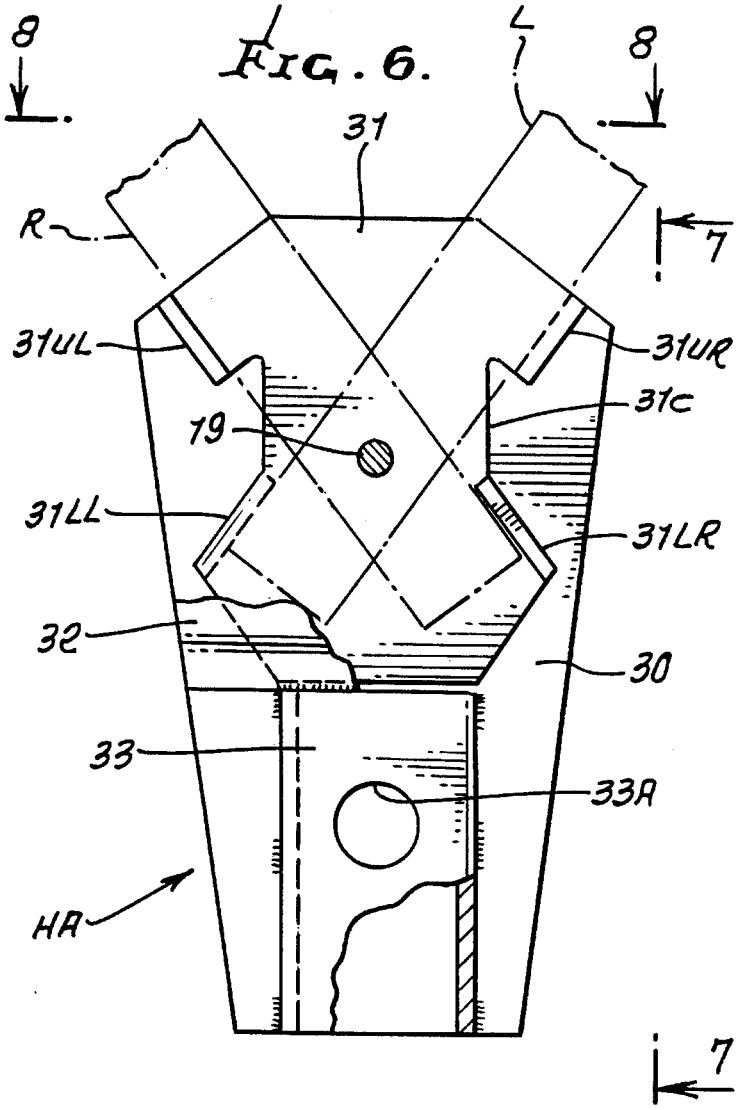
FIG. 6 is a detached, front elevational view of the holding assembly, with the outside cover partially broken away along with a section of the sign stand socket and the angular, flexible members illustrated in dotted outline.
Figure 8:
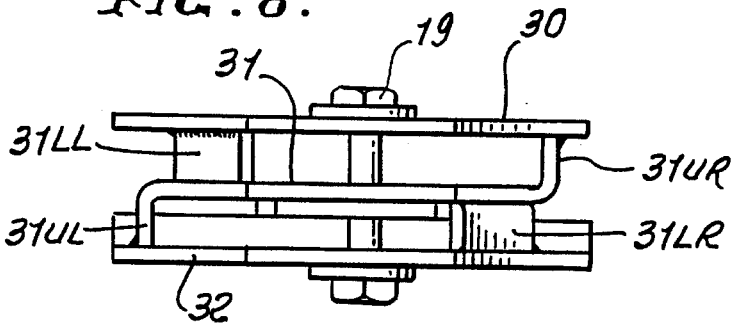
FIG. 8 is a top view taken along the line 8—8 of FIG. 6.

A unique holding assembly HA is provided to hold the members R and L in the desired configuration and to allow ready coupling to the sign stand ST. The detailed construction of the holding assembly HA is illustrated in FIGS. 6 and 8. The holding assembly HA is constructed of three steel plates 30, 31 and 32 arranged in a side by side, spaced relationship to define individual channels for slidably receiving the ends of the members R and L dependent from the sign RS. The plate 30 may be considered the supporting plate and defines the vertical height of the assembly HA. To this end, the lower end of the plate 30 has a decreased width from the opposite end or the top end, and increasingly tapers outwardly towards the top end; see FIG. 6.

The plate 31 may be considered the channel plate and is secured to the plates 30 and 31 for defining channels on the opposite sides thereof for slidably receiving the members R and L. The plate 31 extends from the top of plate 31 to approximately the center of the plate. The channel plate 31 is uniquely formed with a pair of spaced, diagonally related stop members 31UR and 31LL formed from the plate 31 and turned approximately 90 degrees for engagement with the plate 30. The stop members 31UR and 31LL may be welded to the plate 30 to define the channel for slidably receiving the long member L. Similarly, a pair of stop members 31UL and 31LR are formed on the opposite side of the plate 31 (front side as viewed in FIG. 6) for slidably receiving and arresting the member R. These stops 31UL and 31LR are formed from the steel plate 31 by turning them in the opposite direction from the stops on the opposite side so as to be welded to the plate 32 for defining a channel for slidably receiving the member R at the stops 31UL and 31UR. The steel plate 31 has a width essentially the same as the width of the steel plate 30 and has a cutout section or a section 31C of a reduced width between the upper and lower pair of stop members as best illustrated in FIG. 6. The steel plate 32 may be considered the cover plate and is shaped the same as the plate 30 but is basically co-extensive with the plate 31. The top ends of the plates 30 and 32 are tapered at their top ends with a straight section in between as seen in the drawings. When the stop members 31UL and 31LR are welded to the cover member, the two channels are defined on the opposite sides of the plate 32.

The bottom section of the plate 30 is constructed with a mounting socket for coupling the plate 30 to a conventional sign stand. For this purpose, a plate 33 is formed into the shape of a U and welded to the bottom section of the plate 30 as well as the end of the cover plate 32 that is turned inwardly at section 32L to permit the plate 32 to be welded at the top end of the socket plate 33; see FIGS. 6 and 7. The socket plate 33 is provided with a securing aperture 33A adjacent the inner end thereof for securing the holding assembly HA to the sign stand ST.

Figure 7:
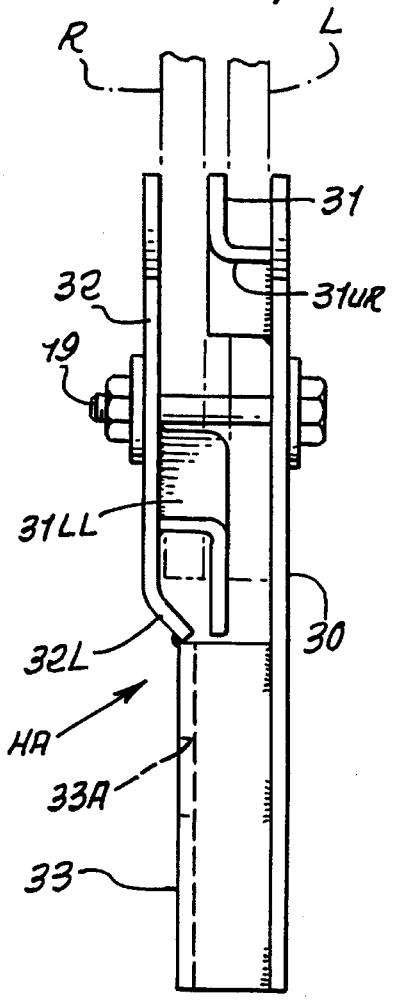
FIG. 7 is an end elevational view of the holding assembly taken along the line 7—7 of FIG. 6.

To complete the assembly of the holding assembly HA with the long members R and L, the members are provided with coaxial apertures adjacent their ends so as to be pivotably secured together by the fastening element 19. In order to pivotably hold the members R and L in the holding assembly HA, a coaxial aperture is provided the steel plates 30–32 intermediate the ends of the cover plate 32. The fastener 19, then is secured in this coaxial aperture and the coaxial aperture for the members R and L so as to pivotably secure them together, as best seen in FIGS. 7 and 8. In this arrangement, the members R and L are pivotably mounted in individual channels defined in the holding assembly HA. The member L is arrested by the stop members 31UR and 31LL while the member R is arrested between the stop members 31UL and 31LR; see FIG. 6. In this assembly, the members R and L are pivotable between an at rest position, illustrated in FIG. 6, to a side by side relationship when the sign is to be disassembled from the sign stand ST so as to be rolled up.

It should be noted at this point that the members R and L constructed of a glass reinforces polyester, plastic pulltrusion is known to split when a hole is drilled in the pulltrusion. The members R and L are constructed in this fashion but do not split and do not require a metal clip adjacent the aperture end due to the unique construction of the holding assembly HA. A pulltrusion member having a U-shaped clip PV functioning as a bearing surface is disclosed in Col. 5, 1. 56 –Col. 6, 1. 2 of U.S. Pat. No. 4,980,984. No such pivot plate is required on the members R and L and no splitting has been experienced in these members due to the advantageous construction of the holding assembly HA. To this end, the above described combination of the members R and L pivotably secured to the assembly HA is such that no load is exerted on the fastener 19 to cause it to split the members.

Figure 9:
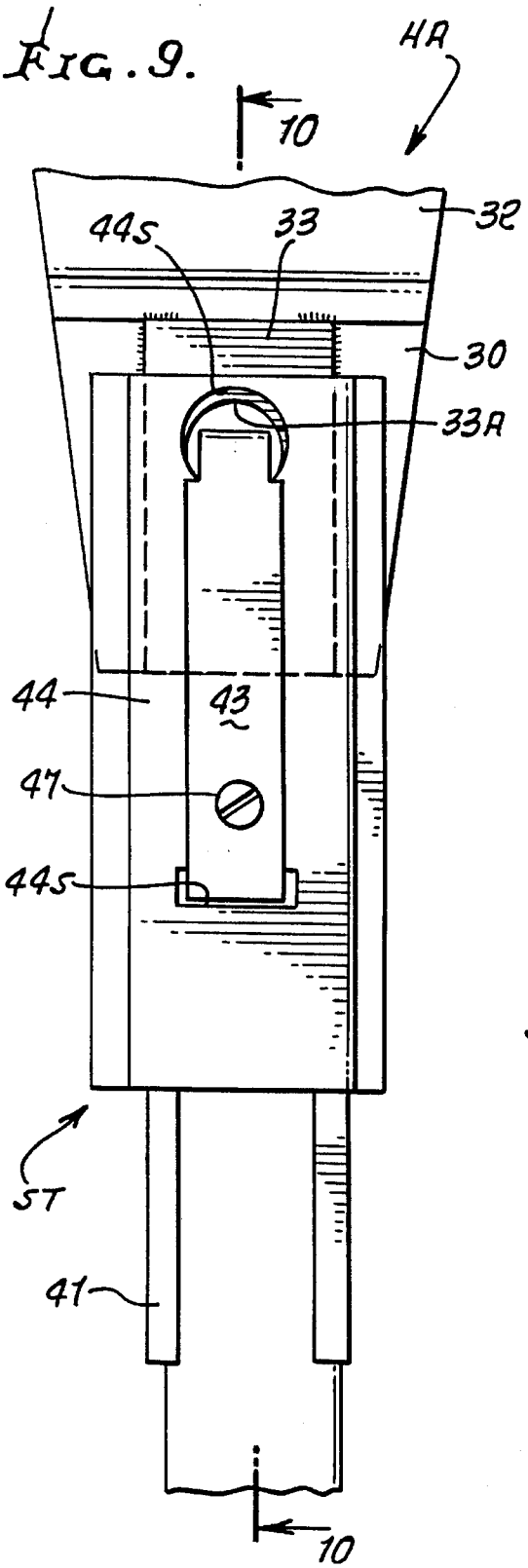
FIG. 9 is an enlarged view of the arrangement of the holding assembly mounted in the sign stand of FIG. 2 and identified as 9.
Figure 10:
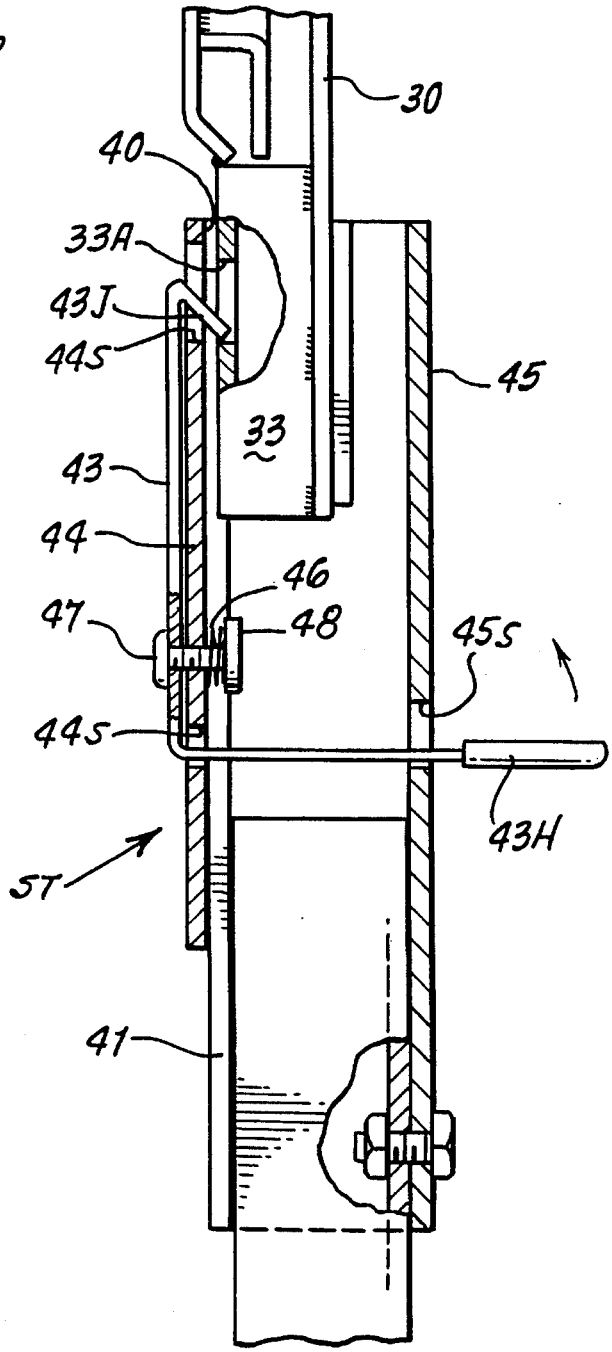
FIG. 10 is a cross-sectional view taken along the line 10—10 of FIG. 9.

Now referring to FIGS. 9 and 10, the principle features of the arrangement of the holding assembly HA as mounted to the top end of the sign stand ST will be explained. The top end of the sign stand ST is illustrated in FIGS. 9 and 10 to illustrate how the holding assembly HA is held therein. The sign stand ST is constructed and defined at its upper end with a sign attaching socket 40 secured to the support housing 41 for the sign stand ST. The socket 40 is securely secured to the support housing 41 so as to bear the weight of the sign RS when the holding assembly HA is assembled thereto. The detailed description of the sign stand per se is described in U.S. Pat. No. 4,888,894 and which disclosure is incorporated herein by reference. The open end of the socket 40 is adapted for receiving the lower end of the holding assembly HA securing the flexible members L and R supporting the sign RS when arranged as in FIG. 1 for display purposes. The socket 40 is constructed and defined with slots (not shown) on the opposite sides of the socket 40 so as to accommodate the sides of the holding assembly HA immediately adjacent the mounting bracket 33, see FIG. 9. A hook 43J is movably mounted to the socket 40 for securing the holding assembly HA in the sign stand ST at the bracket 33. As best seen in FIG. 10, the hook 43J is illustrated in the form of an inverted J structure formed at the free end of a plate 43 resting against the outer surface of one member 44 defining the left hand side of the socket 40, as illustrated in FIG. 10. The member 43 is bent at a right angle to extend through the slot 44S for the member 44 and through the slot 45S for a member 45 defining the opposite side of the socket 40. The free end of member 43 that extends outwardly of the slot 45S may have a handle 43H for manually moving it in a counter-clockwise motion. The hook 43J and the plate 43 resting on the plate 44 are mounted by means of a spring 46 to normally cause the hook 43J to be within the socket 40 when the handle 43H is at rest. The spring 46 is mounted on a fastener 47 carrying a spring seat 48 so as to reside between the seat 48 and the inner wall of the member 44 as illustrated. The hook 43J extends into the socket 40 through an aperture 44S provided for the upper end of the member 44. In its normal position, the hook 43J prevents the sign RS to be accommodated within the socket 40. The operation of the handle 43H in a counter-clockwise direction causes the spring 46 to be compressed and the hook 43J to be withdrawn from the socket 33 and the aperture 44S. At this time, the holding assembly HA may be moved into or removed from the socket 40. The mounting arrangement is such that the mounting bracket 33 on the holding assembly HA has the bottom end inserted into the socket 40 for mounting on the stand ST. With the bracket 33 fully within the socket 40, the mounting aperture 33A on the bracket 33 will be aligned with the hook 43J so as to permit it to move into engagement with the aperture 33A to thereby hold the assembly HA and thereby the sign RS in the stand ST. At this time, the release of the handle 43H will cause the hook 43J to move into the socket 40 and into engagement with the aperture 33A of the mounting bracket 33, as best seen in FIG. 10. When the sign RS is mounted to the sign stand ST as illustrated in FIG. 1, the operation of the handle 43H will release the bracket 33 from the hook 43J to permit the holding assembly HA to be withdrawn from the sign stand ST.

With the above structures in mind, it should be understood that the complete sign 10 comprises two pieces, the sign RS in its assembled condition and the sign stand ST. To set up the sign 10, then, the stand ST is unfolded and placed on a supporting surface. When rolled up the sign RS carrying the reinforcing members are rolled around the long, flexible members L and R and are pivotably secured to the holding assembly HA. In this unfolded and rolled up arrangement, the assembly HA is mounted to the sign stand ST and secured thereto by means of the securing aperture 33A for the socket 33. At this time, the long members R and L are in a side by side relationship and subsequently pivoted open to assume the desired configuration of FIG. 1. The sign RS is expanded to a display position by aligning the frame members 16 and 18 and then releasably locking them together by sliding the clamp 20 over the aligned ends of the members 16 & 18. The sign 10 is now in condition for use on a highway. With this arrangement the sign 10 will move with any winds or wind gusts that impinge on the sign RS and sway about the members R and L. The corner pocket P will move with the sign RS with the impinging wind. Since the mounting socket 33 is constructed of steel it is not subject to damage in the sign stand ST in use and the sign RS itself will not be damaged.

Figure 11:
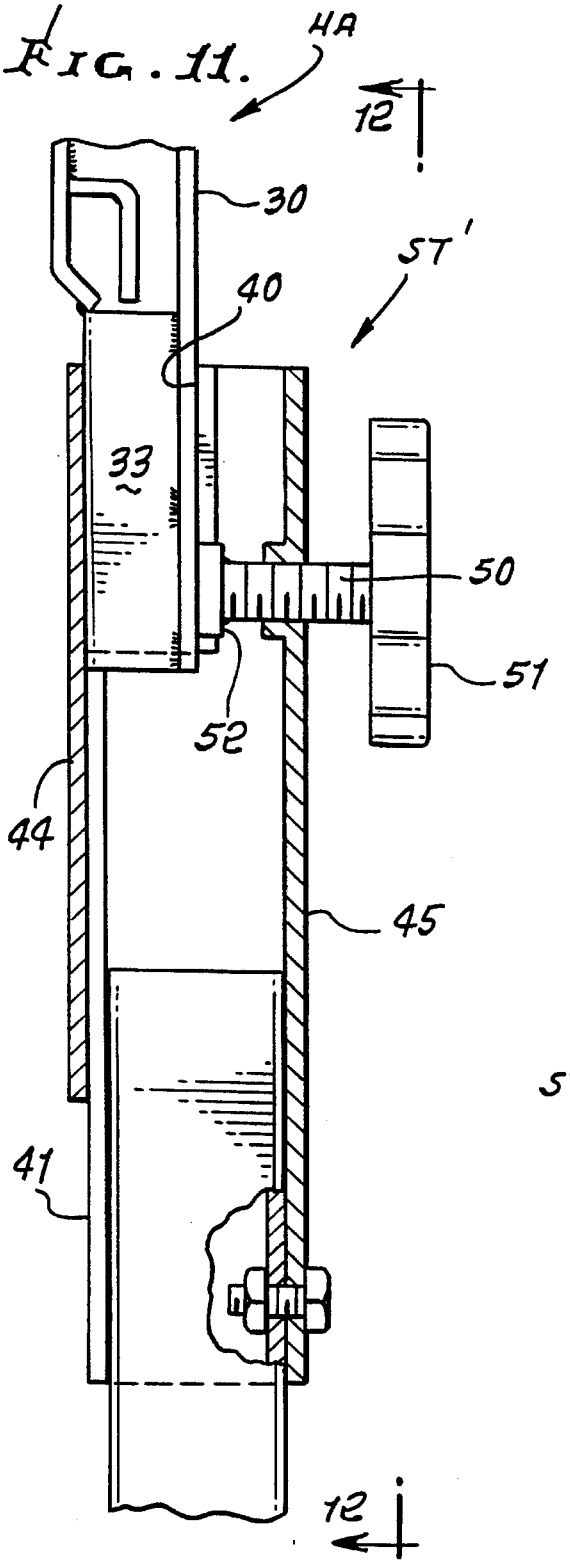
FIG. 11 is a view similar to FIG. 10 illustrating a modified sign stand.
Figure 12:
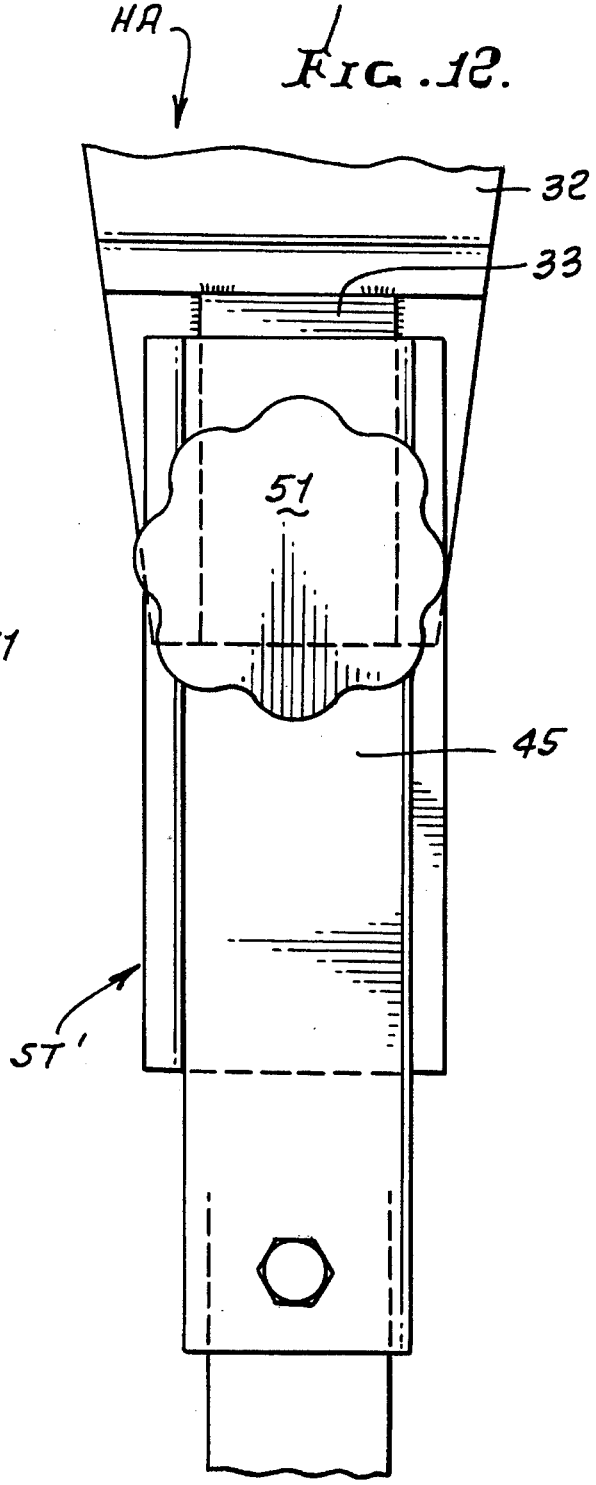
FIG. 12 is a view taken along the line 12—12 of FIG. 11.

Now referring to FIGS. 11 and 12, an improved sign stand ST' will be described. The sign stand ST' is the same as the sign stand ST except that the hook 43J and the operating members 43 for operating the hook may be omitted. Similarly, the latching aperture 33A for the mounting socket 33 is unnecessary. Alternatively, these elements may be maintained and the sign stand ST be modified by adding the necessary structure for securely holding the holding assembly HA in the sign stand ST' without the hook 43J becoming disengaged from the socket 33. To prevent relative movement between the holding assembly HA in the sign stand opening 40, it is desired to tightly secure the holding assembly HA to the sign stand ST', as illustrated in FIGS. 11 and 12. To this end releasable fastening means is provided on the opposite side of the sign stand ST' from the side normally mounting the hook 43J. The releasable fastening means is illustrated in the form of a threaded member 50 rotatably secured to the member 45 and carrying a manually operative handle 51 for rotating the fastener in both directions into and out of the opening 40. The opposite end or the inner end of the fastener 50 carries a stop member 52 for engaging the plate 30 to which the socket 33 is welded. As illustrated in FIG. 11, the handle 51 after being rotated out of the path of the end of the holding assembly HA is rotated in the opposite direction until it tightly seats the stop member 52 against the plate 30 so that the socket 33 is positioned in a nonmovable relationship with the plate 44 for the sign stand ST'. When it is desired to release the holding assembly HA from the sign stand ST' then the handle 51 maybe moved in a counter-clockwise direction to move the stop member 52 away from the plate 30 a sufficient distance to allow the assembly HA to be withdrawn from the opening 40 of the sign stand ST'.

It should now be appreciated by those skilled in the art of regulatory signs that an improved regulatory sign and sign stand has been disclosed that permits the sign and sign stand to be readily assembled together and disassembled from one another. The sign can be rolled up into a single package so as to be readily stored and transported.

We claim:

1. A flexible temporary highway sign capable of being rolled up for storage and portability and having a traffic message thereon on one side thereof to be viewed by an approaching motorist comprising a flexible message panel having a preselected quadrilateral configuration having four corners and capable of being rolled up for storage and transportation and rolled open to assume a substantially flat message displaying position, a plurality of pairs of corner pockets secured adjacent each corner of said message panel on the side opposite said one side having said message thereon, said corner pockets being constructed and defined with individual sockets for receiving and securing an end of a sign reinforcing member, a first pair of flexible, sign reinforcing frame means removable secured along opposed edges of said panel by preselected pairs of said corner pockets, a second pair of flexible, sign reinforcing frame members each being pivotably secured to an individual one of said first pair of flexible, sign reinforcing frame means at a preselected location on said first flexible, sign reinforcing frame means, and means for releasably holding and locking said second pair of flexible, sign reinforcing frame members in a longitudinally aligned position for securing the message panel in a flat, message displaying position, said message panel being capable of being rolled up for storage and/or portability around said pairs of frame means and frame members when said second pair of frame members are released from said longitudinally aligned position.

2. A flexible highway sign as defined in claim 1 wherein said means for releasably holding said second pair of frame members comprises a C-shaped rectangular locking member having a preselected, tapered opening normally mounted on one of said second pair of frame members for receiving the other frame member of said second pair of frame members when the members are moved to an aligned relationship within said C-shaped locking member to cause said second pair of frame members to be locked within said C-shaped member in a releasable locked relationship for holding the message panel in a display position while permitting the C-shaped member to be moved away from the locked position to allow said second pair of frame members to freely pivot relative to one another.

3. A flexible, highway sign as defined in claim 1 or 2 including third pair of flexible frame members of a preselected length pivotably secured to said individual one of said first pair of frame means in common with said second pair of frame members for pivotably maintaining the message panel in an upright, vertical position when said third pair of frame members are held in a preselected, relationship.

4. A flexible, highway sign as defined in claim 1 wherein said second pair of frame members includes means for pivotably securing said second pair of frame members together at a preselected location, said means for pivotably securing said second pair of frame members together includes spacing means of a preselected thickness arranged between the pivoted together second pair of frame members to cause one of said second pair of frame members to be spaced from the other one of said second pair of frame members a preselected distance when mounted within said means for releasably holding and locking said second pair of frame members in a longitudinally aligned secured position within said means for holding.

5. A flexible, highway sign as defined in claim 4 wherein said means for releasably holding said second pair of frame members comprises a C-shaped rectangular open ended member having a preselected, tapered opening to be carried by one of said second pair of frame members and mounted on one side of said means for pivotably securing said second pair of frame members together, said tapered opening for said C-shaped member being arranged adjacent said means for pivotably securing said second pair of frame members together so as to be slidable over the other frame member of said second pair of frame members when the members are moved to an aligned side by side relationship to cause said members to be releasably clamped together when said C-shaped rectangular member is moved to a position adjacent said means for pivotably securing said second pair of frame members together and releasable from the aligned position when said C-shaped rectangular member is moved completely on to said one of said second frame members and away from said pivot means for pivotably securing said second pair of frame members together.

6. A flexible, highway sign as defined in claim 5 wherein said spacing means comprises a relatively thin spacer of a preselected thickness mounted coaxially with said means for pivotably securing said second pair of frame members together between said pair of frame members, the movement of said C-shaped rectangular member to a position adjacent said means for pivotably securing said second pair of frame members causes the aligned frame members to be locked within said C-shaped rectangular member for releasably holding and locking the aligned members of said second pair of frame members in the aligned relationship.

7. A flexible, highway regulatory sign capable of being rolled up for storage and portability comprising a flexible message panel having a rectangular configuration of a preselected length and width and four corners and capable of being rolled up for storage or transportation and rolled open to assume a substantially flat message displaying configuration, said rectangular configuration being further characterized as having a length substantially greater than the width of the sign with the message being displayed on one side thereof, corner pockets secured adjacent each corner of said message panel on the side opposite said one side having a message thereon, said corner pockets being constructed and defined with individual sockets for receiving and securing a sign reinforcing member, said corner pockets being secured adjacent each corner with the sockets opening towards the opposite corner on the same side of the message panel and aligned along said panel, a first pair of frame members each being mounted along said panel to be removably secured in the aligned pair of corner pockets at the corners thereof, and a second pair of flexible sign reinforcing members pivotably secured to one another and pivotably secured to an individual member of said first pair of frame members, and releasable means for holding said second pair of reinforcing members in longitudinal alignment with one another to cause the message panel to assume a message displaying position, said releasable means being releasable to permit said second pair of reinforcing members to pivot away from one another to permit the message panel to be rolled up.

8. A flexible, highway regulatory sign as defined in claim 7 wherein said releasable means for holding said second pair of reinforcing members comprises a releasable C-shaped rectangular member slidably mounted on one of said reinforcing members of said pair of said second pair of reinforcing members and constructed and defined to be slidable over the other of said second pair of reinforcing members and having a tapered slot on one side thereof for locking said second pair of reinforcing members together.

9. A flexible, highway regulatory sign as defined in claim 7 or 8 wherein each of said frame members and reinforcing members are constructed of a pulltruded, glass reinforced plastic.

10. A flexible, highway regulatory sign as defined in claim 8 wherein said releasable C-shaped rectangular member is constructed to be slidable on said one reinforcing member of said second pair of reinforcing members and being tapered from end to end to permit the securement of the pair of second reinforcing members in longitudinal alignment when the C-shaped member is moved over the other one of said second pair of reinforcing members so as to releasably secure said second pair of reinforcing members in longitudinal alignment.

11. A flexible, highway sign as defined in claim 7 wherein said second pair of flexible sign reinforcing members are pivotably secured together along with spacer means of a preselected thickness arranged between said second pair of flexible sign reinforcing members.

12. A flexible, highway regulatory sign capable of being rolled up for storage and portability comprising a flexible message panel having a preselected quadrilateral configuration capable of being rolled up for storage or transportation and rolled open to assume a substantially flat message displaying configuration, a first pair of flexible, reinforcing frame means removably secured to said message panel along a pair of opposed sides of said message panel, a second pair of flexible reinforcing frame means pivotably secured to one another adjacent one end thereof and having the opposite ends thereof pivotably secured to an individual one of said first pair of said flexible, reinforcing frame means at preselected locations to permit the longitudinal extension and alignment of said second pair of reinforcing means for the message panel when it is arranged in a message display position and pivotable with respect to one another to permit the message panel to be rolled up, releasable means for securing said second pair of frame means in longitudinal alignment with one another for arranging the message panel in a displaying position and releasable to a non-aligned position to permit the message panel to be rolled up, a third pair of flexible frame means each being pivotably secured to an individual one of said first pair of frame means secured to said opposed sides of the message panel and having a preselected length for maintaining the message panel in a vertical display position when secured in a vertical, preselected angular relationship, holding means including pivot means for receiving and pivotably securing each of said third pair of flexible frame means in a preselected angular relationship and a foldable sign stand constructed and defined to assume an upright sign mounting position and adapted to receive and secure said holding means for releasably mounting the message panel in an upright, display position, said holding means for receiving and pivotably securing said third pair of flexible frame means comprises flat plate support means having securing means constructed and defined adjacent one end thereof to permit said plate support means to be mounted to and secured to said sign stand, channel plate means having two pairs of spaced members formed from said plate means arranged in a substantially diagonally spaced relationship on opposite sides of said channel plate means, the first pair of stop members being formed with one stop member adjacent one end of the channel plate means so as to extend outwardly of the plane of said plate means and secured to said plate support means in a preselected spaced relationship therewith, and with the second stop member of said first pair of stop members being spaced diagonally downwardly of said one stop member and formed so as to extend outwardly of the plane of said plate means and secured to said plate support means to thereby define a first channel for receiving one frame member of said third pair of flexible frame means between said channel plate means and said plate support means so as to engage the stop members of the first pair of stop members in a substantially diagonal relationship, the second pair of stop members being formed on the opposite side of the channel plate means from said first pair with one stop member being formed adjacent the top of said channel plate means on the opposite end of said plate means from the first stop member of said first pair and extending outwardly of the plane of said plate means in the opposite direction from the first stop member of said first pair and with second stop member of said second pair being spaced diagonally downwardly of the first member of said second pair and formed to extend outwardly in the same direction as the first stop member of said second pair, and cover means defined to overlie said channel plate means and to be secured to the second pair of stop members to thereby define a second channel for receiving the other frame member of said third pair of flexible frame means between said channel plate means and said cover means so as to engage said other frame member at the stop members of the second pair of stop members in a substantially diagonal relationship.

13. A flexible, highway regulatory sign as defined in claim 12 wherein said holding means is constructed and defined to pivotably secure said third pair of frame means without loading the pivoting means therefor, and said pivot means being secured to said third frame means and to said holding means.

14. A flexible, highway regulatory sign as defined in claim 12 or 13 wherein each of said frame means are constructed of a pulltruded, glass reinforced plastic with sufficient stiffness to normally maintain the message panel in an upright message displaying position and yet sufficiently flexible to be flexibly responsive to winds and wind gusts impinging thereon and to return to its upright position upon the cessation or dimunition of the winds or wind gusts.

15. A flexible, highway regulatory sign as defined in claim 14 wherein said releasable means for securing said second pair of frame means comprises a C-shaped rectangular locking member slidably mounted on one of said second pair of frame means and having an internal C-opening to accommodate a portion of the other one of said second pair of frame means within the C-opening in a longitudinally aligned side by side relationship, said C-shaped locking member having a tapered slot, on one side of the member tapering in size from a large opening to a smaller opening for securing the aligned side by side portions of said second frame means at the larger opening when slid over the said aligned portions for releasably locking said side by side portions together for maintaining the message panel in a display position.

* * * * *